United States Patent [19]

Moore et al.

[11] 4,443,307

[45] Apr. 17, 1984

[54] REDUCTION OF AVAILABLE CHLORINE IN ALKALI BRINES

[75] Inventors: Sanders H. Moore; Maurice R. Smith, both of Cleveland, Tenn.

[73] Assignee: Olin Corporation, New Haven, Conn.

[21] Appl. No.: 477,091

[22] Filed: Mar. 21, 1983

[51] Int. Cl.[3] ..... C25B 1/34

[52] U.S. Cl. ..... 204/98; 204/128; 210/749; 210/757; 423/437; 423/462

[58] Field of Search ..... 204/98, 128; 210/749, 210/757; 423/437, 462

[56] References Cited

U.S. PATENT DOCUMENTS

| | | | |
|---|---|---|---|
| 2,610,105 | 9/1952 | Pye | 204/98 |
| 3,849,266 | 11/1974 | Corradi et al. | 204/98 |
| 4,397,720 | 8/1983 | Moore et al. | 204/98 |
| 4,405,465 | 9/1983 | Moore et al. | 204/98 |

FOREIGN PATENT DOCUMENTS

| | | | |
|---|---|---|---|
| 594888 | 3/1960 | Canada | 204/98 |

*Primary Examiner*—R. L. Andrews
*Assistant Examiner*—Terryence Chapman
*Attorney, Agent, or Firm*—Arthur E. Oaks; Donald F. Clements

[57] ABSTRACT

A process is described for removing available chlorine from a depleted recirculating anolyte brine of a chlor-alkali cell. After the spent brine is removed from the cell, and typically after dechlorination, it is reacted with an amount of an organic hydroxyl moiety-containing compound soluble in said brine for a residence time sufficient to substantially reduce the residual dissolved chlorine and hypohalite ion remaining in said brine prior to resaturation and reuse in said cell. Suitable hydroxyl moiety-containing compounds include alcohols and saccharides.

23 Claims, 1 Drawing Figure

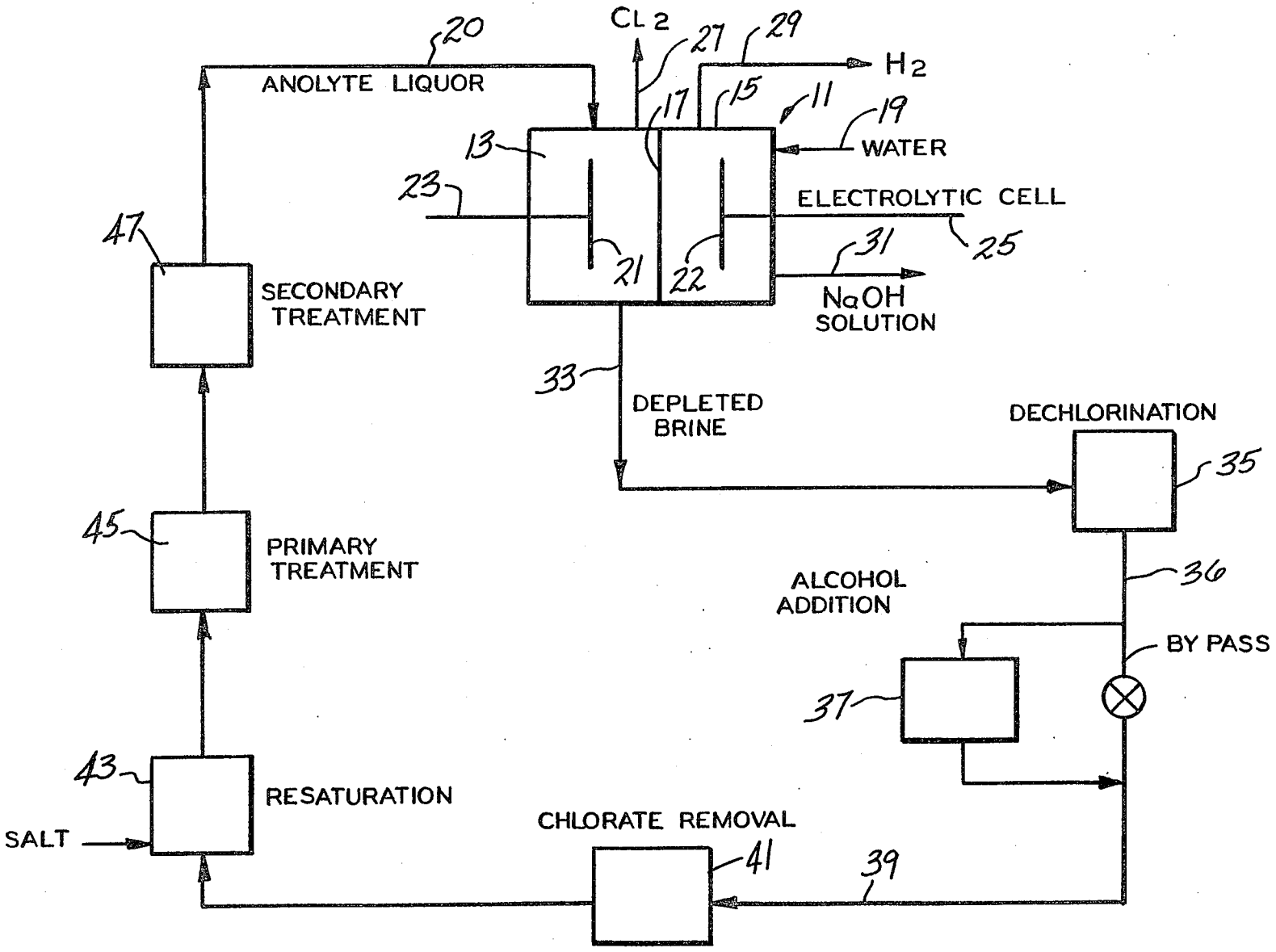
H2
WATER
19
11
29
15
27
17
CL2
ELECTROLYTIC CELL
25
31
NaOH SOLUTION
22
21
13
23
20
ANOLYTE LIQUOR
DEPLETED BRINE
33
DECHLORINATION
35
36
BY PASS
ALCOHOL ADDITION
37
39
CHLORATE REMOVAL
41
SECONDARY TREATMENT
47
PRIMARY TREATMENT
45
RESATURATION
43
SALT

REDUCTION OF AVAILABLE CHLORINE IN ALKALI BRINES

BACKGROUND OF THE INVENTION

The present invention relates to a method of purifying an alkali metal halide brine used in the electrolytic production of high purity alkali metal hydroxide solutions. More particularly, this invention relates to an improved process for removing dissolved chlorine and hypochlorite ions ("available" chlorine) from the brine. The alkali metal halide brines purified in accordance with the present invention are those produced by the passage of an electric current through reconstituted alkali metal halide brines in an electrolytic cell. Electrolytic cells commonly employed in the conversion of alkali metal halide brine to alkali metal hydroxide solutions and halogen fall into one of three general types—diaphragm, mercury and membrane cells.

In the operation of mercury and membrane cells, it is conventional to recycle the depleted or spent brine coming from the anolyte compartment thereof for resaturation and reuse. However, one problem encountered in the operation of such cells is that some of the chlorine gas produced remains dissolved in the brine with the resultant production of hypochlorite and chlorate ions in the anolyte compartment. It has been found in membrane cells that these ions do not readily pass through the cationic permselective membranes used so that they tend to concentrate in the anolyte brine and must be removed before they reach objectionable concentrations. While hypochlorites and chlorates are not known to cause rapid deterioration of anode structures, high concentrations thereof do tend to cause deterioration of the membrane and further, adversely effect the ion-exchange resin used to remove residual calcium and magnesium ions after the primary and secondary treatment. Consequently, the brine treatment systems generally include facilities for one or more additional treatments to substantially reduce the quantity of hypohalite and chlorate ions present therein prior to reuse.

In the past, removal of hypohalites in the brine has been accomplished by standard dechlorination procedures wherein the brine is heated under vacuum for a period of time, followed by the addition of a mineral acid, such as hydrochloric acid and then blowing it with air or $CO_2$ to remove the chlorine present. Such a treatment will lower the hypohalite content to about 0.1 grams per liter as well as substantially lowering the chlorate ion content. However, hydrochloric acid, in particular, is employed, relatively large amounts are often required to effectively reduce the hypochlorite ion concentration to such a level.

Recently, Lai et al., in U.S. Pat. No. 4,169,773, have shown that the amount of acid required to lower the chlorate concentration in a circulating brine stream can be significantly reduced in a procedure in which a portion of said brine stream is reacted with acid prior to dechlorination. In this procedure, substantially all of the hypohalite and chlorate ions therein are destroyed, so that when the treated portion is added back to the main stream, their average values are substantially lowered. However, the system used by Lai et al., calls for a separate dechlorination subsystem for the treated portion and does not completely eliminate all the hypochlorite ions in the brine.

In still another approach, sulfuric acid, as described in British Pat. No. 506,394, issued to I. G. Farbenindustries, or other sulfur-containing compounds such as alkali metal hydrosulfates (U.S. Pat. No. 3,891,747, which issued June 24, 1975 to G. A. Galecki et al.), are also added to the brine after dechlorination to remove residual hypohalites. However, these act to introduce sulfur-oxygen groups which are subsequently oxidized to sulfate. Sulfate ions are undesirable in brines fed to membrane cells and their concentration must be carefully controlled. Such a necessity adds considerably to the overall cost of the procedure.

Most recently, U.S. Pat. No. 4,272,338, which issued June 9, 1981 to Richard W. Lynch et al., teaches the use of an inorganic peroxide such as $H_2O_2$ to remove dissolved hypohalite ions. However, the process also teaches the use of a reducing agent such as an alkali metal thiosulfate to ensure complete removal of hypochlorite ions present.

Now a process has been discovered which substantially reduces the hypohalite ions content of depleted alkali metal brines recovered from electrolytic cells while eliminating the need for the addition of sulfur-containing reducing agents or separate dechlorination facilities.

SUMMARY OF THE INVENTION

The present invention relates to a method for direct treatment of recirculating anolyte alkali metal halide brine from chlor-alkali cell to effectively reduce the hypohalite ion content thereof. Although the process of the present invention may be used in the electrolysis of any alkali metal halide, sodium chloride is normally the alkali metal halide used. However, other alkali metal halides, such as lithium chloride, potassium chloride, lithium bromide, sodium bromide and potassium bromide, may be utilized. Similarly, while the following discussion is in terms of membrane cell anolyte brines, it should be understood that the method described herein can also be applied to anolyte brines from mercury and diaphragm chlor-alkali cells.

The present invention comprises:

(a) collecting at least a portion of said depleted brine; and (b) contacting said collected portion with an amount of an organic hydroxyl moiety-containing compound soluble in said brine, the proportion of said compound being equal to at least about 1 mole of said hydroxyl moiety in said compound per mole of alkali metal hypohalite contained in said brine for a residence time sufficient to substantially reduce said alkali metal hypohalite in said brine, said hydroxyl moiety-containing compound being selected from the group consisting of alcohols and saccharides.

When this is done, before resaturation, it is found that the hypohalite content of said brine is substantially reduced before it is returned to the cell while the aforesaid problems of ion-exchange resin and membrane degradation are largely prevented.

For the purpose of this invention, any hydroxyl moiety-containing compound soluble in brine can be used. Such compounds include mono- and polyhydric alcohols having up to about 6 carbon atoms, and mono- and disaccharides.

Therefore, it is the principal object of the present invention to provide an improved method for reducing the available chlorine content of recirculating anolyte brine.

It is a further object of the invention to provide a method for hypochlorate removal in a recirculating chlor-alkali cell anolyte brines which provide a higher quality brine with lower impurities as compared to previously known available chlorine removal methods.

These and other objects of the invention will become apparent from the following description and the appended claims.

BRIEF DESCRIPTION OF THE DRAWINGS

FIG. 1 is a flow diagram illustrating the process of the present invention.

DETAILED DESCRIPTION OF THE INVENTION

The present invention will be described in more detail by discussion of the accompanying drawing. Membrane cell 11 is comprised of anolyte compartment 13 and catholyte compartment 15. It should be understood that although, as illustrated in the drawing and in the preferred embodiment, the membrane cell is a two compartment cell, a buffer compartment or a plurality of other buffer compartments may be included. Anolyte compartment 13 is sealingly separated from catholyte compartment 15 by cationic permselective membrane 17.

Water is fed into catholyte compartment 15 through inlet line 19. Sodium chloride brine is fed into anolyte compartment 13 by inlet line 20. The sodium chloride brine feed material entering cell 11 generally has from about 250 to about 350 grams per liter of sodium chloride dissolved therein. The solution may be neutral or basic, but is preferably acidified to a pH in the range of from about 1 to about 6, preferably achieved by pretreating it with a suitable acid such as hydrochloric acid. Such a pretreatment is well known and widely used in the art.

Cell 11 is further equipped with anode 21 and cathode 22, suitably connected to a source of direct current through conductors 23 and 25, respectively. Upon passage of a decomposing current through cell 11, chlorine gas is generated at anode 21 and removed from the cell through outlet line 27 for subsequent recovery. Not all of the chlorine generated is recovered. A small amount remains dissolved in the brine wherein at least a portion reacts to form hypochlorite ions, said dissolved chlorine and hypochlorite ions being collectively characterized as available chlorine in the brine.

Hydrogen gas generated at cathode 22 is removed through line 29. Sodium hydroxide solution formed in catholyte compartment 15 is removed through line 31. The sodium hydroxide product is substantially sodium chloride free, generally containing less than about 0.1 percent by weight of sodium chloride and having a concentration of NaOH in the range of from about 20 to about 40 percent by weight.

Depleted brine is removed from anolyte compartment 13 by line 33. As produced in present-day systems, such a brine will contain between about 150 and about 250 grams per liter of sodium chloride and between about 0.1 and about 1.0 grams per liter dissolved free chlorine, about 0.5 and about 1.0 grams hypochlorite ion and about 0.5 and about 5.0 percent chlorate ion along with some percentage of $SO_4^=$ and other dissolved materials at a pH of between about 4 and about 7. Typically, this brine is first dechlorinated in dechlorinator 35 usually by heating it, under about a 0.5 atmosphere vacuum, to a temperature of about 70° C., as a result of which the brine degasses and a substantial portion of dissolved $Cl_2$ flashes off. Residual chlorine is removed by blowing compressed air through the brine after which the "free" chlorine content will generally range from about 0.02 to about 0.03 grams per liter.

The dechlorinated brine is next conveyed through line 36 to available chlorine removal reactor 37 where the dechlorinated brine is reacted with an alcohol of the type described below. After said removal, it proceeds via line 39 to chlorate removal subsystem 41 and resaturator 43, where the brine is reconstituted with fresh salt. The reconstituted salt is subjected to primary and secondary treatment facilities 45 and 47, respectively, where excessive $Ca^{++}$, $Mg^{++}$ and $SO_4^=$ ions are removed. Techniques for these latter two portions of the brine treatment program are well known in the art and need not be repeated here.

In the process of this invention, the residual available chlorine remaining in the dechlorinated brine is substantially reduced by the addition of a molar amount of said hydroxyl moiety equal to between about 1 and about 5 times and preferably between about 1 and about 3 times the molar amount of hypochlorite ion in said brine solution. In the process of this invention, the normal reaction time for hypochlorite removal is between about 5 and about 60 minutes and preferably between about 10 and about 30 minutes. The brine temperature is between about 30° and about 105° C. with between about 60° and about 90° C. being preferred. The brine pH is between about 0 and about 7.

When this procedure is followed, it is unexpectedly found that the brine solution becomes decidedly more acidic and that solutions starting with a pH close to the neutral value of 7 tend to have final pH values in the range of between about 1 and to about 3. Consequently, a result of this treatment is that a smaller quantity of hydrochloric acid will be required to lower the chlorate content to whatever final value is considered to be acceptable for reuse of the brine. This result is unexpected and is a significant advantage of this invention.

For purposes of this invention, the hydroxyl moiety compound is an alcohol or saccharide soluble in said brine. Suitable alcohols include linear aliphatic monohydric alcohols having from 1 up to about 6 carbon atoms. These include primary alcohols such as methyl, ethyl, propyl, butyl, amyl and hexyl alcohol, their isomers, examples of which are methylpropanol, 2-methylbutanol, 3-methylbutanol, 2,3-dimethylbutanol, 2-ethylbutanol, 2-methylpentanol, 3-methylpentanol and 4-methylpentanol. Also usable are secondary alcohols, examples of which are 2-propanol, 2-butanol, 2-pentanol, 3-pentanol, 2-methyl-3-butanol, 2-hexanol, 3-hexanol, 2-methyl-3-pentanol, 3-methyl-2-pentanol, 2-methyl-4-pentanol and 2,2-dimethyl-3-butanol. Still other examples of alcohols which may be used in this process are tertiary alcohols such as 2-methyl-2-propanol (tertiary butyl alcohol), 2-methyl-2-butanol (tertiary amyl alcohol), 3-methyl-3-pentanol and 2-methyl-2-pentanol.

Still other alcohols which may be used in the process of this invention are olefinic monohydric alcohols having from 2 up to about 6 carbon atoms. Primary olefinic alcohols include 2-propen-1-ol (allyl alcohol), 2-buten-1-ol (crotyl alcohol), 3-penten-1-ol, 4-penten-1-ol, 3-hexen-1-ol, 4-hexen-1-ol, 5-hexen-1-ol and related isomeric, secondary and tertiary alcohols within this carbon chain range. Said aliphatic and olefinic monohydric alcohols further include the aromatic substituted forms thereof, examples of which are phenylmethyl alcohol (benzyl alcohol), β-phenylethyl alcohol, phenyldimethyl carbinol, and diphenylmethyl carbinol.

Still other alcohols which may be used in the process of this invention are alicyclic alcohols having from 3 up to about 6 carbon atoms in the ring including cyclopropanol, cyclobutanol, cyclopentanol and cyclohexanol and related cyclic alcohols. A further group of alcohols suitable for the purposes of this invention is linear polyhydric alcohols having from 2 up to about 6 carbon atoms and from 2 up to about 6 hydroxyl groups attached thereto. These include 1,2-ethanediol (ethylene glycol), 1,2-propanediol (propylene glycol), butyl "glycol", pentyl "glycol" and hexyl "glycol", glycerin (1,2,3-propanetriol), butane triol, pentane triol and hexane triol, butyl tetrol, pentapentane tetrol, hexane tetrol, pentaerythritol pentane pentol, hexane pentol and hexane hexol and isomeric forms thereof.

Monosaccharides suitable for the purposes of this invention include dextrose, fructrose and glucose. Disaccharides suitable for the purposes of this invention include sucrose, lactose and maltose.

It is not precisely known what reactions are occurring within available chlorine removal reactor 37. It is believed that for the primary alcohols the oxidation process between the available chlorine and the hydroxyl group of the alcohol proceeds through the normal production of first an aldehyde and then an organic acid with the available chlorine being reduced to chloride ion. Further, with the lower alcohols, such as methyl and ethyl alcohol, ethylene glycol and glycerol, the reaction appears to further proceed in acid media to break down the resultant organic acids to produce carbon dioxide gas and water. Such alcohols are therefore preferred for this use since potential problems with dissolved organic residues are thereby avoided. In the reaction with secondary alcohols, it is probable that the oxidation process proceeds to produce the ketonic form of the alcohol. The reaction of tertiary alcohols with the available chlorine solution is not known to proceed by either of the above reactions so that their applicability to the process of this invention is quite surprising.

Similarly, the activity of saccharides and most especially disaccharides are surprising in this regard. Since the disaccharides tend to hydrolyze to monosaccharides in acid solution, it is postulated that sugar, lactose and maltose, the most commonly available disaccharides, are first hydrolyzed to monosaccharides, and these in turn, react with the available chlorine.

The efficacy of the process of this invention is shown in the following examples. All parts and percentages are by weight unless otherwise specified.

EXAMPLE 1

A 2000-milliliter sample of membrane cell anolyte brine at a temperature of about 90° C. and a pH of about 6.3 was treated with ethylene glycol in an amount equal to 3 moles of ethylene glycol per mole of $OCl^-$ ion with the following result:

TABLE I

| | Initial | 20-Minute Treatment Time |
|---|---|---|
| NaCl (g/l) | 207.9 | 219.9 |
| NaOCl (g/l) | 0.68 | Not Detectable |
| pH (g/l) | 6.3 | 2.2 |

EXAMPLE 2

The procedure of Example 1 was repeated except that the pH was lowered by the addition of hydrochloric acid to between about 0 and about 0.5 with the following results:

TABLE II

| | | Treatment Time | |
|---|---|---|---|
| | Initial | 10-Minute | 20-Minute |
| NaCl (g/l) | 231.6 | 230.2 | 230.2 |
| NaOCl (g/l) | 0.11 | Not Detectable | Not Detectable |

EXAMPLE 3

The procedure of Example 2 was repeated with glycerin being substituted for ethylene glycol with the following results:

TABLE III

| | Initial | 20-Minute Treatment Time |
|---|---|---|
| NaCl (g/l) | 223.4 | 224.2 |
| NaOCl (g/l) | 0.21 | Not Detectable |

EXAMPLE 4

The procedure of Example 1 was followed with 2000-liter samples of membrane cell brine at a temperature of 90° C., a pH of about 6, a total of about 2 grams per liter of combined sodium hypochlorite and sodium chlorate was treated. The first of these samples was treated with 3 moles of methanol per combined mole of OCl and $ClO_3$ and the second with 3 moles of tertiary butyl alcohol per combined mole of $OCl^-$ and $ClO_3^-$ with the following results:

TABLE IV

| | Methanol Treatment Time | | Tertiary Butyl Alcohol Treatment Time | |
|---|---|---|---|---|
| | 10-Minute | 20-Minute | 10-Minute | 20-Minute |
| NaOCl (g/l) | 0.05 | 0.03 | 0.23 | 0.08 |
| $NaClO_3$ (g/l) | 1.49 | 1.46 | 0.97 | 1.09 |

EXAMPLE 5

The procedure of Example 1 was repeated with 8 2000-liter samples of anolyte brine treated with 3 moles of various mono- and polyhydric alcoholic materials for hypochlorite removal with the results shown in Table V.

EXAMPLE 6

The procedure of Example 1 was followed except that 1 mole of reactant was added instead of 3 at a temperature lowered to 60° C. with the results shown in Table VI.

EXAMPLE 7

The procedure of Example 1 was repeated except that the temperature was lowered to 40° C. with the results shown in Table VII.

TABLE V

| | Blank | | | Ethanol | | | Isopentanol | | |
|---|---|---|---|---|---|---|---|---|---|
| | | Treatment Time | | | Treatment Time | | | Treatment Time | |
| | Initial | 10-Minute | 20-Minute | Initial | 10-Minute | 20-Minute | Initial | 10-Minute | 20-Minute |
| NaOCl (g/l) | 0.22 | 0.20 | 0.18 | 0.38 | <0.01 | <0.01 | 0.41 | 0.01 | 0.01 |
| $NaClO_3$ (g/l) | 1.50 | 1.47 | 1.49 | 1.49 | 1.42 | 1.44 | 1.47 | 1.35 | 1.34 |
| NaCl (g/l) | 209.1 | 206.8 | 207.8 | 209.7 | 207.5 | 208.6 | 208.3 | 208.7 | 207.2 |
| pH | 6.0 | 6.1 | 6.1 | 6.4 | 1.9 | 1.9 | 4.3 | 2.2 | 2.0 |
| | Cyclohexanol | | | Propylene Glycol | | | Allyl Alcohol | | |
| | | Treatment Time | | | Treatment Time | | | Treatment Time | |
| | Initial | 10-Minute | 20-Minute | Initial | 10-Minute | 20-Minute | Initial | 10-Minute | 20-Minute |
| NaOCl (g/l) | 0.36 | <0.01 | <0.01 | 0.15 | 0.03 | 0.04 | 1.11 | 0.01 | 0.01 |
| $NaClO_3$ (g/l) | 1.45 | 1.17 | 1.15 | 1.46 | 1.46 | 1.45 | 0.96 | 0.96 | 0.96 |
| NaCl (g/l) | 208.1 | 206.9 | 207.2 | 208.6 | 208.9 | 208.9 | 210.5 | 209.0 | 209.7 |
| pH | 5.0 | 1.8 | 1.7 | 5.1 | 2.4 | 2.3 | 4.9 | 2.1 | 2.4 |
| | Benzyl Alcohol | | | Sucrose* (200 g/l solution) | | | | | |
| | | Treatment Time | | | Treatment Time | | | | |
| | Initial | 10-Minute | 20-Minute | Initial | 10-Minute | 20-Minute | | | |
| NaOCl (g/l) | 1.08 | 0.01 | 0.01 | 0.39 | <0.01 | <0.01 | | | |
| $NaClO_3$ (g/l) | 0.95 | 0.83 | 0.02 | 1.45 | 1.18 | 1.12 | | | |
| NaCl (g/l) | 209.7 | 209.9 | 209.4 | 209.1 | 183.7 | 183.7 | | | |
| pH | 5.3 | 2.6 | 2.1 | 6.0 | 1.9 | 1.9 | | | |

*Lower $NaClO_3$ and NaCl results probably due to dilution resulting from addition of 200 grams per liter of sucrose solution.

TABLE VI

| | Ethanol | | | Sucrose* (200 g/l solution) | | |
|---|---|---|---|---|---|---|
| | | Treatment Time | | | Treatment Time | |
| | Initial | 10-Minute | 20-Minute | Initial | 10-Minute | 20-Minute |
| NaOCl (g/l) | 0.97 | <0.01 | <0.01 | 1.71 | 0.02 | 0.02 |
| $NaClO_3$ (g/l) | 1.00 | 0.83 | 0.85 | 0.98 | 0.81 | 0.81 |
| NaCl (g/l) | 210.2 | 209.9 | 209.6 | 208.1 | 182.5 | 183.2 |
| pH | 5.3 | 1.5 | 1.5 | 5.0 | 1.8 | 1.7 |

*Lower $NaClO_3$ and NaCl results probably due to dilution resulting from addition of 200 grams per liter of sucrose solution.

TABLE VII

| | Ethanol | | | | Allyl Alcohol | | | |
|---|---|---|---|---|---|---|---|---|
| | | Treatment Time | | | | Treatment Time | | |
| | Initial | 10-Minute | 20-Minute | 1-Hour | Initial | 10-Minute | 20-Minute | 30-Minute |
| NaOCl (g/l) | 1.36 | 0.05 | 0.05 | 0.02 | 0.94 | 0.04 | 0.03 | 0.01 |
| $NaClO_3$ (g/l) | 0.89 | 0.71 | 0.78 | 0.77 | 0.94 | 0.05 | 0.05 | 0.04 |
| NaCl (g/l) | 202.1 | 202.0 | 201.5 | 201.4 | 202.0 | 201.6 | 201.8 | 202.0 |
| pH | 5.3 | 1.6 | 1.7 | 1.7 | 5.2 | 7.8 | 7.8 | 5.9 |

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a process for purifying a depleted alkali metal halide brine recovered for reuse in the production of an alkali metal hydroxide and a halogen by electrolysis in a cell wherein a portion of said halogen dissolves in and reacts with said brine to produce an alkali metal hypohalite, said brine being treated to remove said hypohalite ion prior to being resaturated and returned to said cell, the improvement comprising:

(a) collecting at least a portion of said depleted brine after said brine has been dehalogenated; and (b) contacting said collected portion with an amount of an organic hydroxyl moiety-containing compound soluble in said brine, the proportion of said compound being equal to at least about 1 mole of said hydroxyl moiety in said compound per mole of alkali metal hypohalite contained in said brine for a residence time sufficient to substantially reduce said alkali metal hypohalite in said brine, said hydroxyl moiety-containing compound being selected from the group consisting of alcohols and saccharides.

2. The process of claim 1 wherein said alcohol comprises a linear aliphatic monohydric alcohol selected from the group consisting of primary, secondary and tertiary alcohols having from 1 up to about 6 carbon atoms and aromatic substituted forms thereof.

3. The process of claim 2 wherein said alcohol is methanol.

4. The process of claim 2 wherein said alcohol is ethanol.

5. The process of claim 1 wherein said alcohol comprises an olefinic alcohol selected from the group consisting of primary, secondary and tertiary alcohols having from 2 up to about 6 carbon atoms and aromatic substituted forms thereof.

6. The process of claim 5 wherein said alcohol is allyl alcohol.

7. The process of claim 1 wherein said alcohol comprises an alicylic alcohol selected from the group consisting of primary, secondary and tertiary alcohols having from 3 up to about 6 carbon atoms and aromatic substituted forms thereof.

8. The process of claim 7 wherein said alcohol is cyclohexanol.

9. The process of claim 1 wherein said alcohol comprises lineary polyhydric alcohols selected from the group consisting of alcohols having from 2 up to about 6 carbon atoms and from 2 up to about 6 hydroxyl groups therein.

10. The process of claim 9 wherein said alcohol is ethylene glycol.

11. The process of claim 9 wherein said alcohol is glycerin.

12. The process of claim 1 wherein said saccharide comprises monosaccharides and disaccharides.

13. The process of claim 12 wherein said saccharide is sucrose.

14. The process of claim 1 wherein said hydroxyl moiety is added in a molar amount equal to between about 1 and about 5 times the molar quantity of hypochlorite ion in said brine.

15. The process of claim 1 wherein said hydroxyl moiety is added in a molar amount equal to between about 1 and about 3 times the molar quantity of hypochlorite ion in said brine.

16. The process of claim 1 wherein said residence time is between about 5 and about 60 minutes.

17. The process of claim 16 wherein said residence time is between about 10 and about 30 minutes.

18. The process of claim 1 wherein step (b) is performed at a temperature of between about 30° and about 105° C.

19. The process of claim 18 wherein step (b) is performed at a temperature of between about 60° and about 90° C.

20. The process of claim 1 wherein the pH of the brine in step (b) is between about 0 and about 7.

21. The process of claim 1 wherein said alkali metal halide is selected from the group consisting of lithium chloride, sodium chloride, potassium chloride, lithium bromide, sodium bromide and potassium bromide.

22. The process of claim 1 wherein said alkali metal halide is sodium chloride and said hypohalite is sodium hypochlorite.

23. In a process for purifying a depleted sodium chloride brine recovered for reuse in the production of sodium hydroxide and chlorine by electrolysis in a cell wherein a portion of said chlorine dissolves in and reacts with said brine to produce sodium hypochlorite, said brine being treated to remove said hypochlorite ion prior to being resaturated and returned to said cell, the improvement comprising:

(a) collecting at least a portion of said depleted brine after said brine has been dehalogenated; and (b) contacting said collected portion with an amount of an organic hydroxyl moiety-containing compound soluble in said brine, the proportion of said compound being equal to at least about 1 mole of said hydroxyl moiety in said compound per mole of sodium hypochlorite contained in said brine for a residence time sufficient to substantially reduce said sodium hypochlorite in said brine, said hydroxyl moiety-containing compound being selected from the group consisting of methanol, ethanol, isopropanol, tertiary butyl alcohol, allyl alcohol, cyclohexyl alcohol, benzyl alcohol, ethylene glycol, glycerin and sucrose.

* * * * *